US012207688B2

(12) United States Patent
Lim

(10) Patent No.: US 12,207,688 B2
(45) Date of Patent: Jan. 28, 2025

(54) AEROSOL GENERATING DEVICE AND OPERATING METHOD THEREOF

(71) Applicant: KT&G CORPORATION, Daejeon (KR)

(72) Inventor: Hun Il Lim, Seoul (KR)

(73) Assignee: KT&G CORPORATION, Daejeon (KR)

( * ) Notice: Subject to any disclaimer, the term of this patent is extended or adjusted under 35 U.S.C. 154(b) by 681 days.

(21) Appl. No.: 17/424,608

(22) PCT Filed: Dec. 21, 2020

(86) PCT No.: PCT/KR2020/018778
§ 371 (c)(1),
(2) Date: Jul. 21, 2021

(87) PCT Pub. No.: WO2021/157857
PCT Pub. Date: Aug. 12, 2021

(65) Prior Publication Data

US 2022/0295902 A1 Sep. 22, 2022

(30) Foreign Application Priority Data

Feb. 7, 2020 (KR) ..... 10-2020-0015168

(51) Int. Cl.
*A24F 40/57* (2020.01)
*A24F 40/46* (2020.01)
*A24F 40/53* (2020.01)

(52) U.S. Cl.
CPC ..... *A24F 40/57* (2020.01); *A24F 40/46* (2020.01); *A24F 40/53* (2020.01)

(58) Field of Classification Search
CPC ..... A24F 40/53
(Continued)

(56) References Cited

U.S. PATENT DOCUMENTS 9,713,345 B2 7/2017 Farine et al.
10,470,496 B2 11/2019 Bernauer et al.
(Continued)

FOREIGN PATENT DOCUMENTS

CN 107407941 A 11/2017
CN 110691523 A 1/2020
(Continued)

OTHER PUBLICATIONS

Korea Intellectual Property Office Notice of Non-Final Rejection for KR 10-2020-0015168 dated May 20, 2021.
(Continued)

*Primary Examiner* — Tomi Skibinski
(74) *Attorney, Agent, or Firm* — Sughrue Mion, PLLC

(57) ABSTRACT

An aerosol generating device and a method of controlling thereof are provided. The aerosol generating device may include a heater configured to heat an aerosol generating material, a battery configured to supply power to the heater, a micro controller unit (MCU) configured to control an operation of the heater, and a protection circuit controller. The protection circuit controller may be configured to acquire at least one parameter related to the operation of the heater to detect and control an abnormal operation of the heater based on the at least one parameter.

10 Claims, 9 Drawing Sheets

(58) Field of Classification Search
USPC ..... 327/142
See application file for complete search history.

(56) References Cited

U.S. PATENT DOCUMENTS

| | | | | |
|---|---|---|---|---|
| 10,667,329 | B2 | 5/2020 | Bernauer et al. | |
| 10,674,771 | B2 | 6/2020 | Buchberger | |
| 11,596,182 | B2 | 3/2023 | Lee et al. | |
| 2007/0074734 | A1 | 4/2007 | Braunshteyn et al. | |
| 2014/0285937 | A1 | 9/2014 | Xiang | |
| 2015/0237916 | A1 | 8/2015 | Farine et al. | |
| 2016/0331038 | A1 | 11/2016 | Farine et al. | |
| 2017/0359856 | A1 | 12/2017 | Qiu | |
| 2018/0084608 | A1 | 3/2018 | Bernauer et al. | |
| 2019/0342950 | A1* | 11/2019 | Bernauer | A24F 40/50 |
| 2019/0387795 | A1 | 12/2019 | Fisher et al. | |
| 2020/0260791 | A1 | 8/2020 | Lee et al. | |
| 2020/0305512 | A1 | 10/2020 | Lim et al. | |
| 2021/0186113 | A1 | 6/2021 | Lee | |

FOREIGN PATENT DOCUMENTS

| | | | |
|---|---|---|---|
| KR | 10-2015-0084779 | A | 7/2015 |
| KR | 10-2017-0137066 | A | 12/2017 |
| KR | 10-2019-0035478 | A | 4/2019 |
| KR | 10-2019-0035486 | A | 4/2019 |
| KR | 10-2019-0089087 | A | 7/2019 |
| WO | 2020/017783 | A1 | 1/2020 |

OTHER PUBLICATIONS

International Search Report for PCT/KR2020/018778 dated Mar. 26, 2021 [PCT/ISA/210].
Written Opinion for PCT/KR2020/018778 dated Mar. 26, 2021 [PCT/ISA/237].
Office Action dated Mar. 31, 2023 from the Chinese Patent Office in Application No. 202080016193.3.
Extended European Search Report dated Mar. 3, 2022 in European Application No. 20911307.5.

* cited by examiner

AEROSOL GENERATING DEVICE AND OPERATING METHOD THEREOF

CROSS REFERENCE TO RELATED APPLICATIONS

This application is a National Stage of International Application No. PCT/KR2020/018778 filed Dec. 21, 2020, claiming priority based on Korean Patent Application No. 10-2020-0015168 filed Feb. 7, 2020.

TECHNICAL FIELD

The disclosure relates to an aerosol generating device and an operating method thereof.

BACKGROUND ART

In recent years, demands for alternative methods of overcoming shortcomings of general cigarettes have been increased. For example, there is an increasing demand for a method of generating aerosol by heating an aerosol generating material, rather than by combusting cigarettes.

DISCLOSURE OF INVENTION

Technical Problem

In an aerosol generating device, a heater is used to heat an aerosol generating material. When the heater malfunctions, a user's smoking satisfaction may decrease, and the safety of the device may be compromised. Accordingly, there is a need to prevent malfunctioning of the heater.

Solution to Problem

One or more embodiments include an aerosol generating device and an operating method thereof. One or more embodiments also include a device and method capable of accurately determining whether or not puffs are generated, considering the atmospheric pressure around the aerosol generating device. One or more embodiments also include a computer-readable recording medium having a program for executing the operating method of the aerosol generating device on a computer.

The technical problems of the present disclosure are not limited to the above-described technical problems, and other technical problems may be solved by the embodiments to be described hereinafter.

Advantageous Effects of Invention

According to an aspect of the present disclosure, a protection circuit controller may prevent an operation period of a heating unit from exceeding a preset time, thereby preventing an accident such as a fire. Also, the protection circuit controller may be implemented by hardware independent of a micro controller unit (MCU), so that, even if an error occurs in the MCU, the protection circuit controller may operate normally and prevent the heating unit from operating beyond the preset time.

In addition, according to an aspect of the present disclosure, the protection circuit controller may determine whether or not a duty ratio of power supplied to the heating unit is maintained at the same value for a certain time so that a user's smoking satisfaction may not decrease and an accident such as a fire may be prevented. Furthermore, because the protection circuit controller may be implemented by hardware independent of the MCU, even if an error occurs in the MCU, the protection circuit controller may operate normally and continuously monitor the duty ratio of power supplied to the heating unit.

BEST MODE FOR CARRYING OUT THE INVENTION

Figure 1:
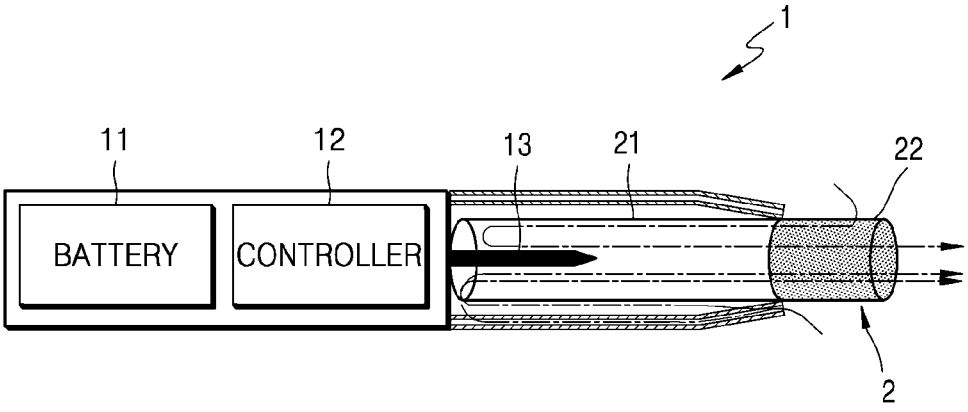
FIGS. 1 through 3 are diagrams showing examples in which a cigarette is inserted into an aerosol generating device.

According to an aspect of the present disclosure, an aerosol generating device includes a heater configured to heat an aerosol generating material, a battery configured to supply power to the heater, a micro controller unit (MCU) configured to control the heater and a protection circuit controller configured to acquire at least one parameter related to an operation of the heater to detect and control an abnormal operation of the heater based on the at least one parameter.

The protection circuit controller may measure an operation period of the heater and compare the operation period with a first threshold value.

The protection circuit controller may further include a timer, and the timer is configured to start measuring time when the operation of the heater starts and stop measuring the time when the operation of the heater is stopped.

The protection circuit controller may receive a duty ratio of power supplied to the heater from the MCU, and based on the duty ratio being maintained at a same value for a preset time, stop supplying the power to the heater.

The protection circuit controller may further include a comparator, and the comparator may determine whether the duty ratio is maintained at the same value for the preset time.

The aerosol generating device may further include a load switch configured to receive the power from the battery and to transmit the received power to the heater.

When the power transmitted to the heater is out of a preset range, the load switch is configured to transmit an error signal to the protection circuit controller, and based on receiving the error signal, the protection circuit controller may be configured to control the load switch to stop supplying the power to the heater.

The aerosol generating device may further include a load switch configured to receive the power from the battery and to transmit the received power to the heater, and the protection circuit controller may be configured to control the load switch to stop supplying the power to the heater based on the operation period exceeding the first threshold value.

The aerosol generating device may further include a load switch configured to receive the power from the battery and to transmit the received power to the heater, and the protection circuit controller may control the load switch to stop supplying the power to the heater based on the duty ratio being maintained at the same value for the preset time.

The MCU may be configured to control the power supplied to the heater based on a proportional-integral-differential (PID) algorithm.

According to another aspect of the present disclosure, a method of controlling an aerosol generating device includes acquiring at least one parameter related to an operation of a heater and controlling an abnormal operation of the heater based on the at least one parameter.

The acquiring may include measuring an operation period of the heater, and the controlling may include comparing the operation period with a first threshold value.

The acquiring may include receiving a duty ratio of power supplied to the heater, and the controlling may include stopping the supply of power to the heater when the duty ratio is maintained at the same value for a certain time.

The acquiring may include receiving an error signal indicating that power delivered to the heater is out of a preset range, and the controlling may include stopping the supply of power to the heater in response to the error signal.

According to another aspect of the present disclosure, there is provided a non-transitory computer-readable recording medium having recorded thereon a program for executing the above-described method on a computer.

MODE FOR THE INVENTION

As used herein, expressions such as "at least one of," when preceding a list of elements, modify the entire list of elements and do not modify the individual elements of the list. For example, the expression, "at least one of a, b, and c," should be understood as including only a, only b, only c, both a and b, both a and c, both b and c, or all of a, b, and c.

It will be understood that when an element is referred to as being "over," "above," "on," "connected to" or "coupled to" another element, it can be directly over, above, on, connected or coupled to the other element or intervening elements may be present. In contrast, when an element is referred to as being "directly over," "directly above," "directly on," "directly connected to" or "directly coupled to" another element, there are no intervening elements present.

With respect to the terms used to describe the various embodiments, general terms which are currently and widely used are selected in consideration of functions of structural elements in the various embodiments of the present disclosure. However, meanings of the terms can be changed according to the intention of one of ordinary skill in the art, a judicial precedents, an emergence of new technology, and the like. In addition, in certain cases, a term which is not commonly used can be selected. In such a case, the meaning of the term will be described in detail at the corresponding portion in the description of the present disclosure. Therefore, the terms used in the various embodiments of the present disclosure should be defined based on the meanings of the terms and in the context of the descriptions provided herein.

In addition, unless explicitly indicated otherwise, the word "comprise" and variations such as "comprises" or "comprising" will be understood to imply the inclusion of stated elements but not the exclusion of any other elements. In addition, the terms "-er", "-or", and "module" may refer to units for processing at least one function and/or operation and can be implemented by hardware components or software components and combinations thereof.

Hereinafter, the present disclosure will now be described in more detail with reference to the accompanying drawings, in which exemplary embodiments of the present disclosure are shown such that one of ordinary skill in the art may easily understand and practice the present disclosure. The disclosure may, however, be embodied in many different forms and should not be construed as being limited to the embodiments set forth herein.

Hereinafter, the present disclosure will now be described more fully with reference to the accompanying drawings.

Figure 2:
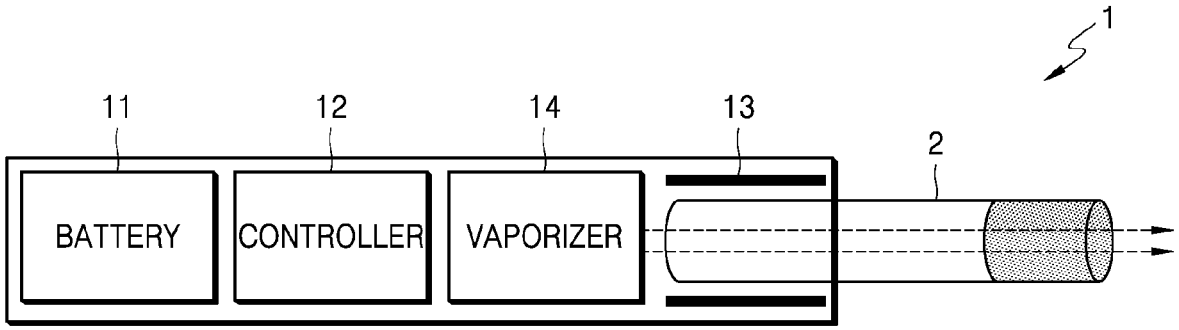
Figure 3:
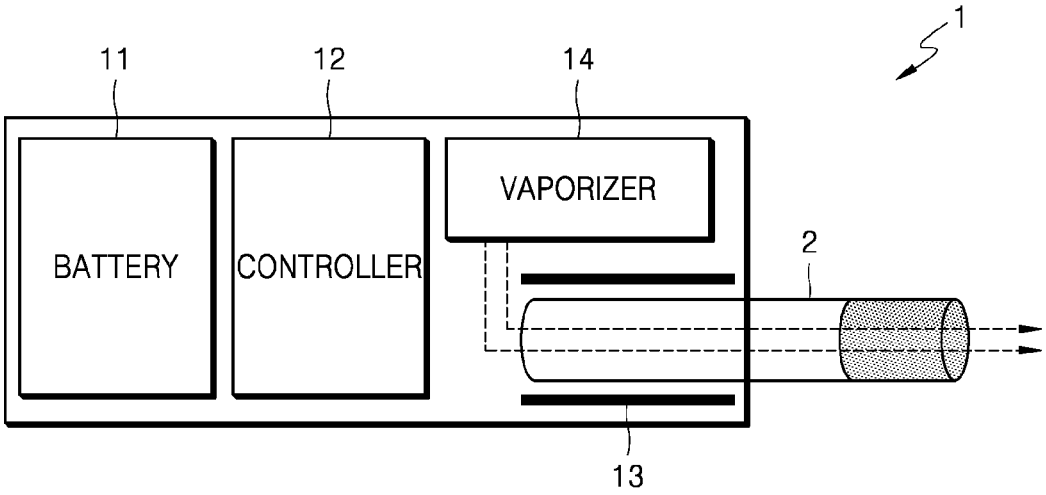

FIGS. 1 through 3 are diagrams showing examples in which a cigarette is inserted into an aerosol generating device.

Referring to FIG. 1, the aerosol generating device 1 may include a battery 11, a controller 12, and a heater 13. Referring to FIGS. 2 and 3, the aerosol generating device 1 may further include a vaporizer 14. Also, the cigarette 2 may be inserted into an inner space of the aerosol generating device 1.

FIGS. 1 through 3 illustrate components of the aerosol generating device 1, which are related to the present embodiment. It will be understood by one of ordinary skill in the art related to the present embodiment that other components may be further included in the aerosol generating device 1, in addition to the components illustrated in FIGS. 1 through 3.

Also, FIGS. 2 and 3 illustrate that the aerosol generating device 1 includes the heater 13. However, according to necessity, the heater 13 may be omitted.

FIG. 1 illustrates that the battery 11, the controller 12, and the heater 13 are arranged in series. Also, FIG. 2 illustrates that the battery 11, the controller 12, the vaporizer 14, and the heater 13 are arranged in series. Also, FIG. 3 illustrates that the vaporizer 14 and the heater 13 are arranged in parallel. However, the internal structure of the aerosol generating device 1 is not limited to the structures illustrated in FIGS. 1 through 3. In other words, according to the design of the aerosol generating device 1, the battery 11, the controller 12, the heater 13, and the vaporizer 14 may be arranged differently.

When the cigarette 2 is inserted into the aerosol generating device 1, the aerosol generating device 1 may operate the heater 13 and/or the vaporizer 14 to generate an aerosol from the cigarette 2 and/or the vaporizer 14. The aerosol generated by the heater 13 and/or the vaporizer 14 is delivered to a user through the cigarette 2.

According to necessity, even when the cigarette 2 is not inserted into the aerosol generating device 1, the aerosol generating device 1 may heat the heater 13.

The battery 11 may supply power to operate the aerosol generating device 1. For example, the battery 11 may supply power to heat the heater 13 or the vaporizer 14, and may supply power for operating the controller 12. Also, the battery 11 may supply power for operations of a display, a sensor, a motor, etc. included in the aerosol generating device 1.

The controller 12 may control overall operations of the aerosol generating device 1. Specifically, the controller 12 may control not only the operations of the battery 11, the heater 13, and the vaporizer 14, but also operations of other components included in the aerosol generating device 1. Also, the controller 12 may check a state of each of the components of the aerosol generating device 1 to determine whether or not the aerosol generating device 1 is in an operable state.

The controller 12 may include at least one processor. A processor can be implemented as an array of a plurality of logic gates or can be implemented as a combination of a microprocessor and a memory in which a program executable by the microprocessor is stored. Also, it will be understood by one of ordinary skill in the art that the processor can be implemented in other forms of hardware.

The heater 13 may be heated by the power supplied from the battery 11. For example, when the cigarette 2 is inserted into the aerosol generating device 1, the heater 13 may be located outside the cigarette 2. Thus, the heated heater 13 may increase a temperature of an aerosol generating material in the cigarette 2.

The heater 13 may include an electro-resistive heater. For example, the heater 13 may include an electrically conductive track, and the heater 13 may be heated when currents flow through the electrically conductive track. However, the heater 13 is not limited to the example described above and may include all heaters which may be heated to a desired temperature. Here, the desired temperature may be pre-set in the aerosol generating device 1 or may be set to a temperature input by a user.

As another example, the heater 13 may include an induction heater. Specifically, the heater 13 may include an electrically conductive coil for heating a cigarette in an induction heating method, and the cigarette may include a susceptor which may be heated by the induction heater.

For example, the heater 13 may include a tube-type heating element, a plate-type heating element, a needle-type heating element, or a rod-type heating element, and may heat the inside or the outside of the cigarette 2, according to the shape of the heating element.

Also, the aerosol generating device 1 may include a plurality of heaters 13. Here, the plurality of heaters 13 may be inserted into the cigarette 2 or may be arranged outside the cigarette 2. Also, some of the plurality of heaters 13 may be inserted into the cigarette 2 and the others may be arranged outside the cigarette 2. In addition, the shape of the heater 13 is not limited to the shapes illustrated in FIGS. 1 through 3 and may include various shapes.

The vaporizer 14 may generate an aerosol by heating a liquid composition and the generated aerosol may pass through the cigarette 2 and delivered to a user. In other words, the aerosol generated via the vaporizer 14 may move along an air flow passage of the aerosol generating device 1 and the air flow passage may be configured such that the aerosol generated via the vaporizer 14 passes through the cigarette 2 to be delivered to the user.

For example, the vaporizer 14 may include a liquid storage, a liquid delivery element, and a heating element, but it is not limited thereto. For example, the liquid storage, the liquid delivery element, and the heating element may be included in the aerosol generating device 1 as independent modules.

The liquid storage may store a liquid composition. For example, the liquid composition may be a liquid including a tobacco-containing material having a volatile tobacco flavor component, or a liquid including a non-tobacco material. The liquid storage may be formed to be attached to/detached from the vaporizer 14 or may be formed integrally with the vaporizer 14.

For example, the liquid composition may include water, a solvent, ethanol, plant extract, spices, flavorings, or a vitamin mixture. The spices may include menthol, peppermint, spearmint oil, and various fruit-flavored ingredients, but are not limited thereto. The flavorings may include ingredients capable of providing various flavors or tastes to a user. Vitamin mixtures may be a mixture of at least one of vitamin A, vitamin B, vitamin C, and vitamin E, but are not limited thereto. Also, the liquid composition may include an aerosol forming substance, such as glycerin and propylene glycol.

The liquid delivery element may deliver the liquid composition of the liquid storage to the heating element. For example, the liquid delivery element may be a wick such as cotton fiber, ceramic fiber, glass fiber, or porous ceramic, but is not limited thereto.

The heating element is an element for heating the liquid composition delivered by the liquid delivery element. For example, the heating element may be a metal heating wire, a metal hot plate, a ceramic heater, or the like, but is not limited thereto. In addition, the heating element may include a conductive filament such as nichrome wire and may be wound around the liquid delivery element. The heating element may be heated by a current supply and may transfer heat to the liquid composition in contact with the heating element, thereby heating the liquid composition. As a result, aerosol may be generated.

In addition, the vaporizer 14 may also be referred to as a cartomizer or an atomizer, but it is not limited thereto.

The aerosol generating device 1 may include other components in addition to the battery 11, the controller 12, the heater 13, and the vaporizer 14. For example, the aerosol generating device 1 may include a display capable of outputting visual information and/or a motor for outputting haptic information. Also, the aerosol generating device 1 may include at least one sensor (a puff detecting sensor, a temperature detecting sensor, a cigarette insertion detecting sensor, etc.). Also, the aerosol generating device 1 may be formed as a structure where, even when the cigarette 2 is inserted into the aerosol generating device 1, external air may be introduced or internal air may be discharged.

Although not illustrated in FIGS. 1 through 3, the aerosol generating device 1 and an additional cradle (not shown) may form together a system. For example, the cradle may be used to charge the battery 11 of the aerosol generating device 1. Alternatively, the heater 13 may be heated when the cradle and the aerosol generating device 1 are coupled to each other.

The cigarette 2 may be similar to a general combustive cigarette. For example, the cigarette 2 may be divided into a first portion including an aerosol generating material and a second portion including a filter, etc. Alternatively, the second portion of the cigarette 2 may also include an aerosol generating material. For example, an aerosol generating material made in the form of granules or capsules may be inserted into the second portion.

The entire first portion may be inserted into the aerosol generating device 1, and the second portion may be exposed to the outside. Alternatively, only a portion of the first portion may be inserted into the aerosol generating device 1, or the entire first portion and a portion of the second portion may be inserted into the aerosol generating device 1. The user may puff aerosol while holding the second portion by the mouth of the user. In this case, the aerosol is generated by the external air passing through the first portion, and the generated aerosol passes through the second portion and is delivered to the user's mouth.

For example, the external air may flow into at least one air passage formed in the aerosol generating device 1. For example, the opening and closing and/or a size of the air passage formed in the aerosol generating device 1 may be adjusted by the user. Accordingly, the amount of smoke and a smoking impression may be adjusted by the user. As another example, the external air may flow into the cigarette 2 through at least one hole formed on a surface of the cigarette 2.

Hereinafter, an example of the cigarette 2 will be described with reference to FIG. 4 and FIG. 5.

Figure 4:
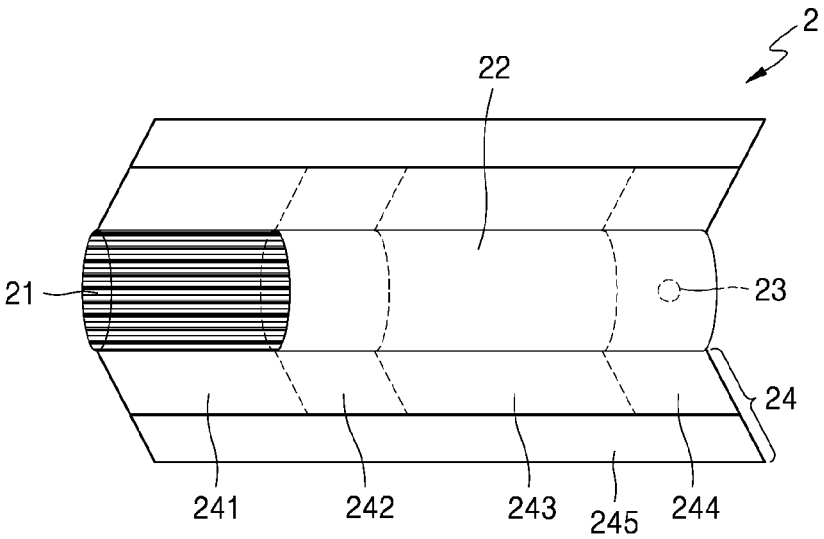
FIGS. 4 through 5 are diagrams showing examples of a cigarette.
Figure 5:
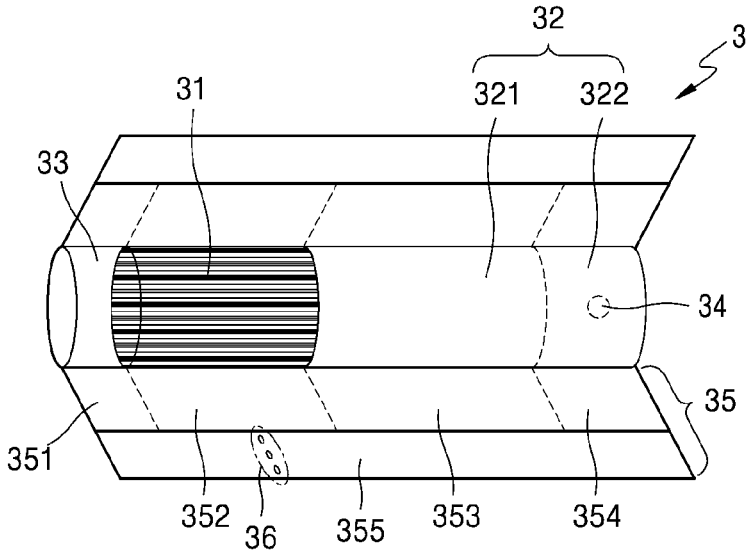

FIG. 4 and FIG. 5 illustrate an example of a cigarette.

Referring to FIG. 4, the cigarette 2 may include a tobacco rod 21 and a filter rod 22. The first portion described above with reference to FIGS. 1 through 3 may include the tobacco rod 21, and the second portion may include the filter rod 22.

FIG. 4 illustrates that the filter rod 22 includes a single segment. However, the filter rod 22 is not limited thereto, and the filter rod 22 may include a plurality of segments. For example, the filter rod 22 may include a first segment configured to cool an aerosol and a second segment configured to filter a certain component included in the aerosol. Also, according to necessity, the filter rod 22 may further include at least one segment configured to perform other functions.

The cigarette 2 may be packaged via at least one wrapper 24. The wrapper 24 may have at least one hole through which external air may be introduced or internal air may be discharged. For example, the cigarette 2 may be packaged via one wrapper 24. As another example, the cigarette 2 may be double-packaged via at least two wrappers 24. For example, the tobacco rod 21 may be packaged via a first wrapper 241, and the filter rod 22 may be packaged via wrappers 242, 243 and 244. Also, the entire cigarette 2 may be packaged via a single wrapper 245. When the filter rod 22 includes a plurality of segments, each segment may be packaged via separate wrapper 242, 243 and 244.

The tobacco rod 21 may include an aerosol generating material. For example, the aerosol generating material may include at least one of glycerin, propylene glycol, ethylene glycol, dipropylene glycol, diethylene glycol, triethylene glycol, tetraethylene glycol, and oleyl alcohol, but it is not limited thereto. Also, the tobacco rod 21 may include other additives, such as flavors, a wetting agent, and/or organic acid. Also, the tobacco rod 21 may include a flavored liquid, such as menthol or a moisturizer, which may be injected into the tobacco rod 21.

The tobacco rod 21 may be manufactured in various forms. For example, the tobacco rod 21 may be formed as a sheet or a strand. Also, the tobacco rod 21 may be formed as a pipe tobacco, which is formed of tiny bits cut from a tobacco sheet. Also, the tobacco rod 21 may be surrounded by a heat conductive material. For example, the heat-conducting material may be, but is not limited to, a metal foil such as an aluminum foil. For example, the heat conductive material surrounding the tobacco rod 21 may uniformly distribute heat to the tobacco rod 21, and thus, the heat conductivity applied to the tobacco rod may be increased and taste of the tobacco may be improved. Also, the heat conductive material surrounding the tobacco rod 21 may function as a susceptor heated by the induction heater. Here, although not illustrated in the accompanying drawings, the tobacco rod 21 may further include an additional susceptor, in addition to the heat conductive material surrounding the tobacco rod 21.

The filter rod 22 may include a cellulose acetate filter. Shapes of the filter rod 22 are not limited. For example, the filter rod 22 may include a cylinder-type rod or a tube-type rod having a hollow inside. Also, the filter rod 22 may include a recess-type rod. When the filter rod 22 includes a plurality of segments, at least one of the plurality of segments may have a different shape.

Also, the filter rod 22 may include at least one capsule 23. Here, the capsule 23 may generate a flavor or an aerosol. For example, the capsule 23 may have a configuration in which a liquid including a flavoring material is wrapped with a film. For example, the capsule 23 may have a spherical or cylindrical shape, but is not limited thereto.

Referring to FIG. 5, the cigarette 3 may further include a front-end plug 33. The front-end plug 33 may be located on one side of the tobacco rod 31 which is opposite to the filter rod 32. The front-end plug 33 may prevent the tobacco rod 31 from being detached outwards and prevent a liquefied aerosol from flowing into the aerosol generating device 1 (FIGS. 1 through 3) from the tobacco rod 31, during smoking.

The filter rod 32 may include a first segment 321 and second segment 322. Here, the first segment 321 may correspond to a first segment of a filter rod 22 of FIG. 4, and the second segment 322 may correspond to a third segment of a filter rod 22 of FIG. 4.

The diameter and the total length of the cigarette 3 may correspond to the diameter and the total length of the cigarette 2 of FIG. 4. For example, the length of the front-end plug 33 may be about 7 mm, the length of the tobacco rod 31 may be about 15 mm, the length of the first segment 321 may be about 12 mm, and the length of the second segment 322 may be about 14 mm, but the length of each part of the cigarette 3 is not limited to this.

The cigarette 3 may be packaged via at least one wrapper 35. The wrapper 35 may have at least one hole through which external air may be introduced or internal air may be discharged. For example, the front-end plug 33 may be packaged via a first wrapper 351, the tobacco rod 31 may be packaged via a second wrapper 352, the first segment 321 may be packaged via a third wrapper 353, and the second segment 322 may be packaged via a fourth wrapper 354. Also, the entire cigarette 3 may be packaged via a fifth wrapper 355.

In addition, the fifth wrapper 355 may have at least one hole 36. For example, the hole 36 may be formed in an area surrounding the tobacco rod 31, but is not limited thereto. The hole 36 may serve to transfer heat formed by the heater 13 shown in FIG. 2 and FIG. 3 to the inside of the tobacco rod 31.

Also, the second segment 322 may include at least one capsule 34. Here, the capsule 34 may generate a flavor or an aerosol. For example, the capsule 34 may have a configuration in which a liquid containing a flavoring material is wrapped with a film. For example, the capsule 34 may have a spherical or cylindrical shape, but is not limited thereto.

Figure 6:
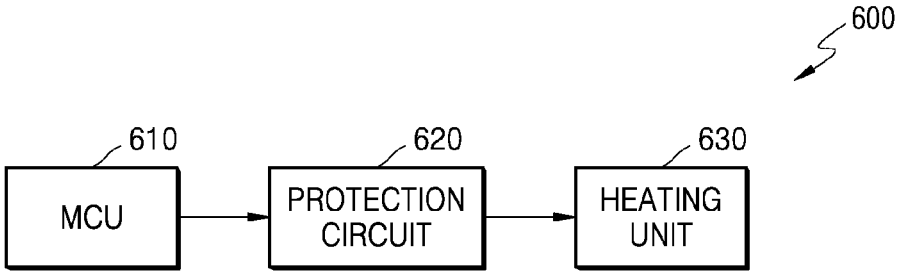
FIG. 6 is a block diagram of an aerosol generating device including a protection circuit according to an embodiment.

FIG. 6 is a block diagram of an aerosol generating device including a protection circuit according to an embodiment.

An aerosol generating device 600 may include a micro controller unit (MCU) 610, a protection circuit 620, and a heating unit 630. The heating unit 630 may include at least one of the heater 13 and the vaporizer 14 of FIG. 3.

The MCU 610 may be hardware for controlling the overall operation of the aerosol generating device 600. The MCU 610 may include at least one processor. A processor can be implemented as an array of a plurality of logic gates or can be implemented as a combination of a microprocessor and a memory in which a program executable by the microprocessor is stored. Also, it will be understood by those skilled in the art to which the present embodiment belongs that the MCU 610 may be implemented by other types of hardware.

The MCU 610 may control the overall operation of the heating unit 630. In an embodiment, the MCU 610 may control power supplied to the heating unit 630 so that the operation of the heating unit 630 may be started or ended based on the result sensed by at least one sensor. Also, the MCU 610 may control the amount of power supplied to the heating unit 630 and a power supply time so that the heating unit 630 may be heated to a certain temperature or maintained at a certain temperature based on the result sensed by at least one sensor.

The MCU 610 may control the amount of power to be supplied to the heating unit 630. In an embodiment, the MCU 610 may control the duty ratio of power supplied to the heating unit 630 using a proportional-integral-differential (PID) control method. The PID control method is a combination of proportional control (P control), integral control (I control) and differential control (D control).

P control is a control method in which a difference from a target value is multiplied by a constant gain. P control is controlled in the form of fluctuating signal based on a deviation from the target value. When the control operation is performed by multiplying the gain using P control, the target value may be quickly approached. When the target value cannot be properly obtained by only P control, such as in a second or higher system, I control and/or D control methods may be used.

I control is a control method in which errors are integrated and fed back. In other words, I control is a control method in which errors are accumulated and reflected in a next round. In P control, when PI control is performed with a largely fluctuating value, overshoot gradually decreases and the target value may be obtained. On the other hand, if only PI control is performed, there are arithmetically and finely fluctuating values as residual deviations, and the measured values may vibrate for a considerable time due to the residual deviation.

D control is a control method in which errors are differentiated and fed back to a control system. When D control is added to the PI control, differentiation is applied in the form of a proportional and integrated graph. By removing the residual deviation, a vibration system may be controlled to obtain the target value without error within an appropriate time.

In another embodiment, the MCU 610 may control the duty ratio of power supplied to the heating unit 630 using a pulse width modulation (PWM) control method. For example, the duty ratio may be set differently for each progression of puff series. As the puff series progresses, the MCU 610 may supply power to the heating unit 630 based on the preset duty ratio.

Also, at least one algorithm for preventing an abnormal operation of the heating unit 630 may be applied to the MCU 610. For example, an algorithm for detecting that the heating unit 630 operates beyond the preset time may be applied to the MCU 610. Also, an algorithm for detecting that the duty ratio of the power supplied to the heating unit 630 is maintained at the same value for a certain time, may be applied to the MCU 610. Also, an algorithm for detecting that an overcurrent and/or a short current flows through the heating unit 630, may be applied to the MCU 610.

However, even if at least one algorithm for preventing the abnormal operation of the heating unit 630 is applied to the MCU 610, when errors occur in the MCU 610, the abnormal operation of the heating unit 630 may no longer be prevented.

In an embodiment, the aerosol generating device 600 may provide a protection circuit 620 for implementing the algorithm applied to the above-described MCU 610. The protection circuit 620 may be implemented by hardware independent of the MCU 610.

The protection circuit 620 may acquire a parameter related to the operation of the heating unit 630 and may prevent the abnormal operation of the heating unit 630 based on the acquired parameter.

For example, the protection circuit 620 may acquire the operation period of the heating unit 630 as a parameter. The protection circuit 620 may measure the operation period of the heating unit 630, compare the operation period with a first threshold value, and stop supplying power to the heating unit 630.

Also, the protection circuit 620 may acquire the duty ratio of power supplied to the heating unit 630 as a parameter. The protection circuit 620 may receive the duty ratio of power supplied to the heating unit 630 from the MCU 610 and may stop supplying power to the heating unit 630 when the duty ratio is maintained at the same value for a certain time.

Also, the protection circuit 620 may acquire the power supplied to the heating unit 630 as a parameter. When the power supplied to the heating unit 630 is out of a preset range, the protection circuit 620 may stop supplying power to the heating unit 630.

Also, the aerosol generating device 600 may further include a memory. The memory is hardware for storing various data to be processed within the aerosol generating device 600 and may store data processed and to be processed by the MCU 610 and the protection circuit 620. The memory may be implemented with various types of memories, such as random access memory (RAM) such as dynamic random access memory (DRAM), static random access memory (SRAM), or the like, read-only memory (ROM), electrically erasable programmable read-only memory, and the like.

For example, data related to the operation period of the heating unit 630, data related to the duty ratio of power supplied to the heating unit 630, and data related to power supplied to the heating unit 630 may be stored in the memory.

Figure 7:
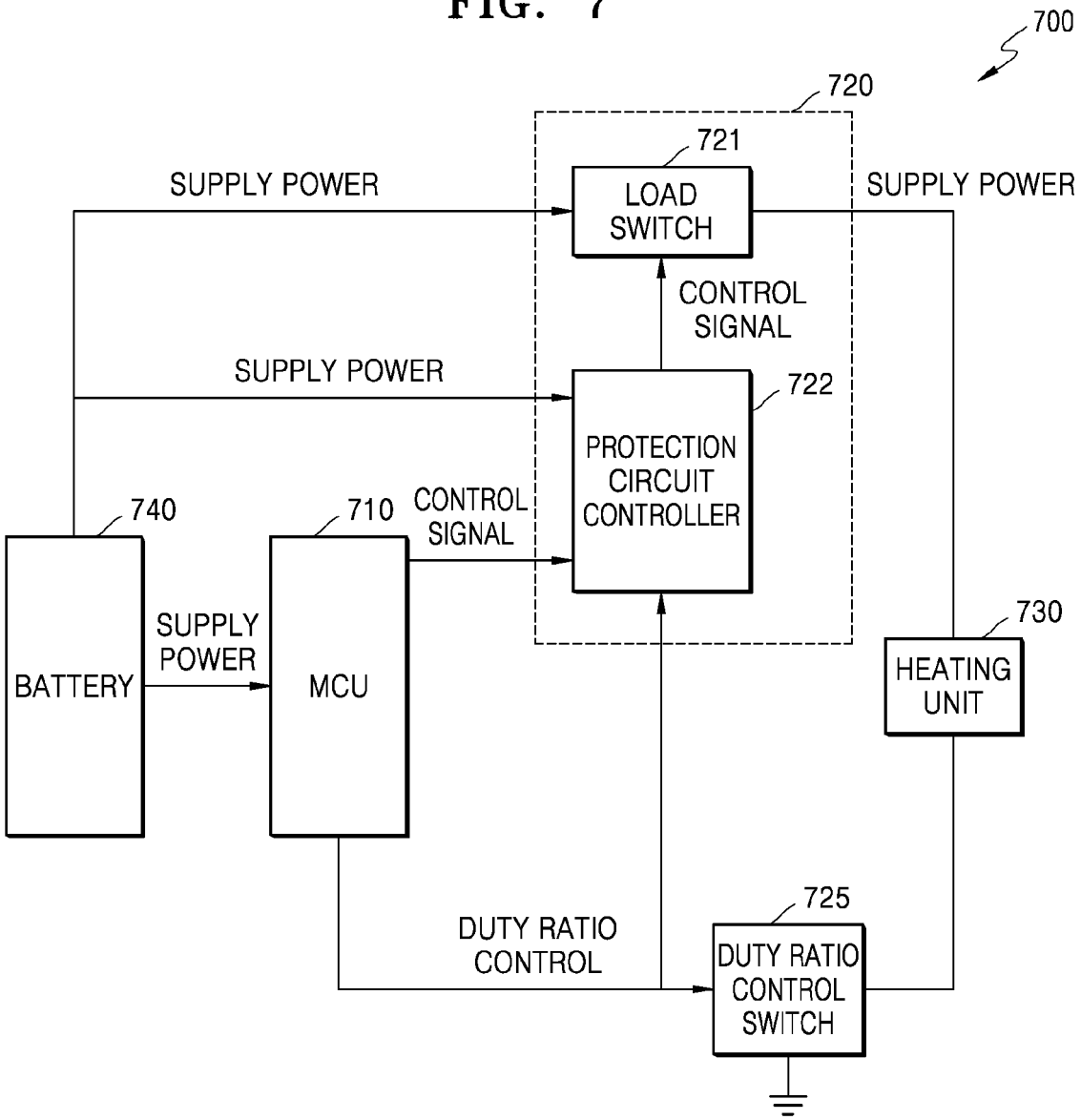
FIG. 7 is a block diagram illustrating an operation of the protection circuit according to an embodiment.

FIG. 7 is a block diagram for describing an operation of a protection circuit according to an embodiment.

Referring to FIG. 7, a battery 740 may supply power required to operate the aerosol generating device 700. The battery 740 may be a rechargeable battery or a disposable battery. For example, the battery 740 may be a lithium polymer (LiPoly) battery, but is not limited thereto.

The battery 740 may supply power to the MCU 710, a protection circuit controller 722, and a load switch 721. It will be understood by those skilled in the art to which the present embodiment belongs, that components other than the components shown in FIG. 7 may receive power from the battery 740.

The MCU 710 may control the operation of the heating unit 730. The MCU 710 may supply power to the heating unit 730 or stop the supply of power. The MCU 710 may detect the abnormal operation of the heating unit 730 through the protection circuit 720 to stop supplying power to the heating unit 730.

Also, the MCU 710 may control the amount of power to be supplied to the heating unit 730. In an embodiment, the MCU 710 may control the duty ratio of power to be supplied to the heating unit 730 using the PID control method. The PID control method may be a combination of proportional control (P control), integral control (I control), and differential control (D control).

The MCU 710 may be electrically connected to the protection circuit 720. The protection circuit 720 may include a protection circuit controller 722 and a load switch 721. The protection circuit controller 722 may receive power from the battery 740. The protection circuit controller 722 may receive a control signal from the MCU 710.

The protection circuit controller 722 may be implemented by hardware independent of the MCU 710. For example, the protection circuit controller 722 may be implemented by a field programmable gate array (FPGA), but is not limited thereto.

The protection circuit controller 722 may acquire at least one parameter related to the operation of the heating unit 730. Also, the protection circuit controller 722 may prevent the abnormal operation of the heating unit 730 based on the parameter.

In an embodiment, the protection circuit controller 722 may acquire the operation period of the heating unit 730 as a parameter. The protection circuit controller 722 may measure the operation period of the heating unit 730, compare the operation period with a first threshold value, and stop the supply of power to the heating unit 730.

The MCU 710 may transmit a duty ratio control signal to the duty ratio control switch 725 so as to control the amount of power to be supplied the heating unit 730 using the PID control method. In an embodiment, the protection circuit controller 722 may acquire the duty ratio control signal (or a duty ratio) transmitted to the duty ratio control switch 725 as a parameter. The protection circuit controller 722 may receive the duty ratio of power supplied to the heating unit 730 from the MCU 710 and may stop supplying power to the heating unit 730 when the duty ratio is maintained at the same value for a certain time.

In an embodiment, the protection circuit controller 722 may acquire power delivered to the heating unit 730 as a parameter. When power delivered to the heating unit 730 is out of a preset range, the protection circuit controller 722 may stop supplying power to the heating unit 730.

Figure 8:
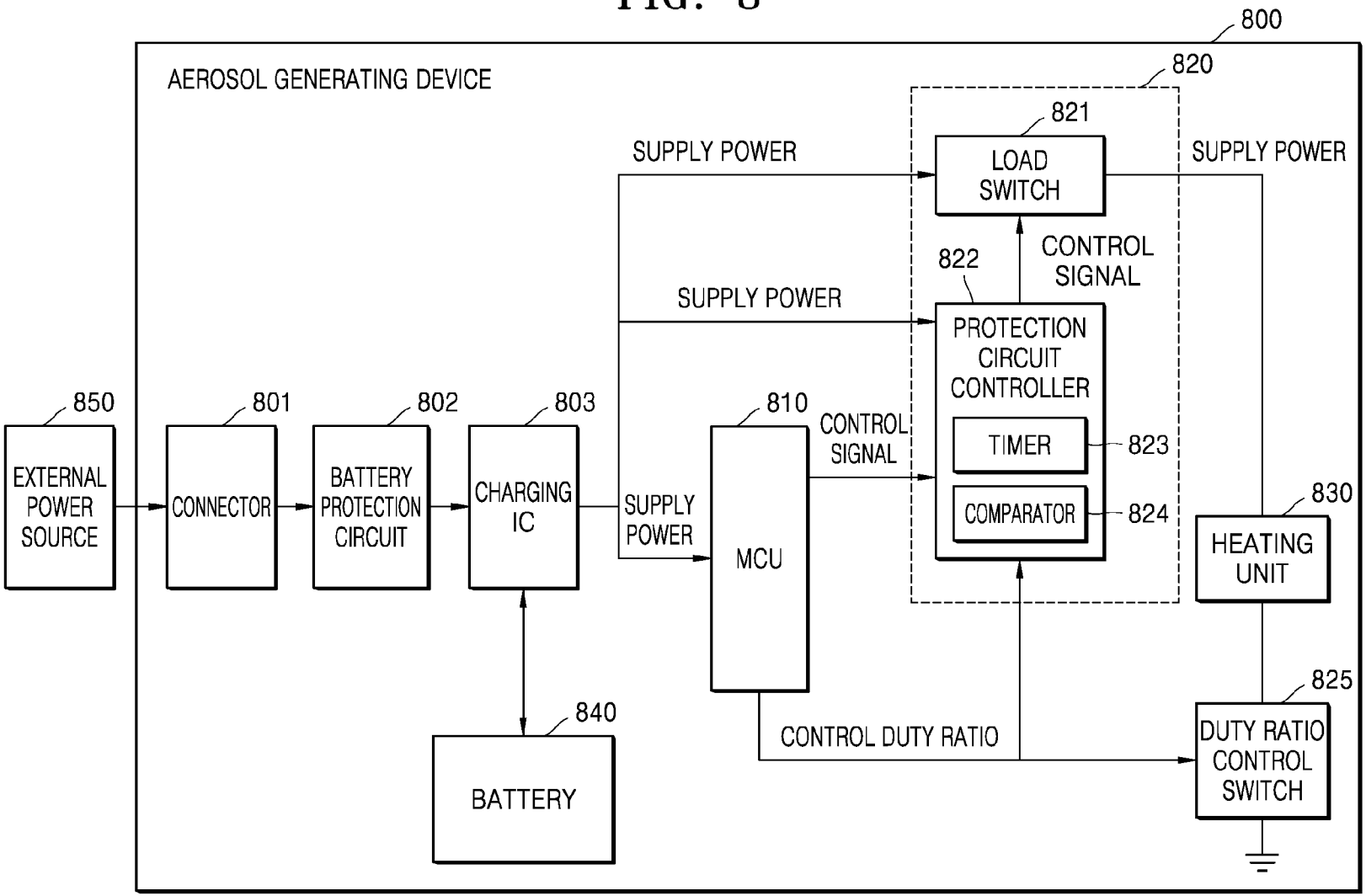
FIG. 8 is a block diagram of an aerosol generating device including a protection circuit according to an embodiment.

FIG. 8 is a block diagram of an aerosol generating device including a protection circuit according to an embodiment.

Referring to FIG. 8, an aerosol generating device 800 may receive power from an external power source 850 through a connector 801. For example, the connector 801 may be a universal serial bus (USB) connector, but is not limited thereto.

The connector 801 may be electrically connected to the battery protection circuit 802. The battery protection circuit 802 may perform one or more of various functions for preventing degradation or burnout of the aerosol generating device 800. For example, the battery protection circuit 802 may include an over voltage protection (OVP) circuit.

The battery protection circuit 802 may be electrically connected to a charging integrated chip (IC) 803. The charging IC 803 may charge or discharge the battery 840 based on whether or not power is received from the external power source 850.

For example, when the connector 801 receives power from the external power source 850, the charging IC 803 may charge the battery 840 using the received power, and when the connector 801 does not receive power from the external power source 850, the charging IC 803 may discharge the battery 840 so that power may be supplied to other components of the aerosol generating device 800.

The charging IC 803 may be electrically connected to the battery 840. The charging IC 803 may receive power from the battery 840 to supply power required for the operation of other hardware components included in the aerosol generating device 800. Referring to FIG. 8, the charging IC 803 may supply power to an MCU 810, a protection circuit controller 822, and a load switch 821.

The MCU 810 may control the operation of the heating unit 830. Also, the MCU 810 may control the amount of power to be supplied to the heating unit 830.

The MCU 810 may be electrically connected to the protection circuit 820. The protection circuit 820 may include the protection circuit controller 822 and the load switch 821. The protection circuit controller 822 may receive power from the charging IC 803. The protection circuit controller 822 may receive a control signal from the MCU 810.

The protection circuit controller 822 may acquire at least one parameter related to the operation of the heating unit 830. Also, the protection circuit controller 822 may prevent the abnormal operation of the heating unit 830 based on the at least one parameter.

In an embodiment, the protection circuit controller 822 may include a timer 823. The protection circuit controller 822 may acquire the operation period of the heating unit 830 as a parameter by using the timer 823.

When the operation of the heating unit 830 starts, the timer 823 may start measurement, and when the operation of the heating unit 830 is stopped, the timer 823 may stop the measurement. Specifically, when power starts to be supplied to the heating unit 830, the protection circuit controller 822 may start the operation of the timer 823.

Also, when the supply of power to the heating unit 830 is stopped, the protection circuit controller 822 may stop the operation of the timer 823. That is, the timer 823 may measure the operation period of the heating unit 830 when the operation starts or is stopped based on whether or not power is supplied to the heating unit 830.

The protection circuit controller 822 may prevent an abnormal operation of the heating unit 830 based on the operation period of the heating unit 830.

Specifically, the protection circuit controller 822 may prevent an abnormal operation of the heating unit 830 based on the operation period of the heating unit 830 received from the timer 823. When the received operation period exceeds the first threshold value, the protection circuit controller 822 may determine that the heating unit 830 is operating abnormally and may stop supplying power to the heating unit 830. For example, the first threshold value may be 10 seconds, 15 seconds, 20 seconds, 30 seconds, 60 seconds, or the like, but is not limited thereto.

Operating of the heating unit 830 beyond a preset time may cause an accident such as a fire. The protection circuit controller 822 according to the present disclosure may measure the operation period of the heating unit 830 using the timer 823, thereby preventing the heating unit 830 from operating beyond the preset time.

Also, the protection circuit controller 822 according to an embodiment may be implemented by hardware independent of the MCU 810. That is, the protection circuit controller 822 according to the embodiment may start or stop measurement of the timer 823 based on whether or not power is supplied to the heating unit 830 regardless of the control of the MCU 810. Thus, when errors occur in the MCU 810 and the MCU 810 does not detect that the heating unit 830 operates beyond the preset time, the heating unit 830 may be prevented from operating beyond the preset time by the protection circuit controller 822 according to the embodiment.

In an embodiment, the protection circuit controller 822 may include a comparator 824. The protection circuit controller 822 may acquire the duty ratio of power supplied to the heating unit 830 as a parameter by using the comparator 824.

The MCU 810 may control the amount of power supplied to the heating unit 830 using the PID control method. The MCU 810 may transmit the duty ratio control signal to the duty ratio control switch 825 so as to control the duty ratio of power supplied to the heating unit 830 according to the PID control method. At this time, the MCU 810 may transmit the duty ratio control signal transmitted to the duty ratio control switch 825 to the protection circuit controller 822.

The protection circuit controller 822 may prevent an abnormal operation of the heating unit 830 based on the duty ratio of power supplied to the heating unit 830.

Specifically, the comparator 824 of the protection circuit controller 822 may determine whether the duty ratio of power supplied to the heating unit 830 is maintained at the same value for a certain time. For example, the certain time may be 5 seconds, 10 seconds, 15 seconds, or the like, but is not limited thereto.

When the MCU 810 controls the amount of power to be supplied to the heating unit 830 using the PID control method, the duty ratio is changed continuously. That is, the duty ratio of power supplied to the heating unit 830 maintained at the same value for a certain time may be a case where errors occur in a duty ratio control algorithm of the MCU 810.

When the amount of power supplied to the heating unit 830 is not controlled according to the PID control method and the same duty ratio is supplied to the heating unit 830 for a certain time, the user's smoking satisfaction may decrease. Also, this may cause an accident such as a fire.

The protection circuit controller 822 according to an embodiment may monitor the duty ratio of power supplied to the heating unit 830 by using the comparator 824, thereby determining whether or not the duty ratio of power supplied to the heating unit 830 is maintained at the same value for a certain time. Thus, the user's smoking satisfaction may be prevented from decreasing, and an accident such as a fire may be prevented.

Also, the protection circuit controller 822 according to an embodiment may be implemented by hardware independent of the MCU 810. That is, even when errors occur in the MCU 810 and the MCU 810 does not perform duty ratio control properly, the abnormal operation of the heating unit 830 may be prevented by the protection circuit controller 822.

In an embodiment, the protection circuit 820 may include the load switch 821. The load switch 821 may receive power from the charging IC 803. The load switch 821 may receive a control signal from the protection circuit controller 822. Also, the load switch 821 may deliver power received from the charging IC 803 to the heating unit 830.

The load switch 821 may be controlled to be turned on or off according to the control signal of the protection circuit controller 822, and when the load switch 821 is turned on, power may be supplied to the heating unit 830, and when the load switch 821 is turned off, the supply of power to the heating unit 830 may be stopped.

The load switch 821 may perform an active current limit (ACL) function and a short circuit limit (SCL) function. The ACL function may be a function in which the flow of an overcurrent is detected and a circuit is cut off, and the SCL function may be a function in which the flow of a short current is detected and the circuit is cut off. However, the load switch 821 may further include other functions than the above-described functions.

When power delivered to the heating unit 830 is out of the preset range, the load switch 821 may deliver an error signal to the protection circuit controller 822. Alternatively, when power delivered to the heating unit 830 is out of the preset range, the load switch 821 may deliver the error signal to the MCU 810, and the MCU 810 may deliver the error signal to the protection circuit controller 822. After receiving the error signal, the protection circuit controller 822 may control the load switch 821 to stop supplying power to the heating unit 830.

For example, when power delivered to the heating unit 830 from the load switch 821 exceeds a threshold upper limit, the load switch 821 may determine that an overcurrent flows through the heating unit 830 and may transmit a first error signal to the protection circuit controller 822.

Also, when power delivered to the heating unit 830 from the load switch 821 is less than or equal to a threshold lower limit, the load switch 821 may determine that a short current flows through the heating unit 830 and may transmit a second error signal to the protection circuit controller 822.

After receiving the first error signal or the second error signal, the protection circuit controller 822 may control the load switch 821 to stop supplying power to the heating unit 830.

The overcurrent or short current flowing through the heating unit 830 may cause an accident such as a fire. The protection circuit 820 according to the embodiment may include the load switch 821, and when power delivered to the heating unit 830 is out of the preset range, the load switch 821 may deliver the error signal to the protection circuit controller 822, thereby preventing an accident such as a fire.

Also, the load switch 821 or the protection circuit controller 822 according to an embodiment may be implemented by hardware independent of the MCU 810. Even if an algorithm for detecting an overcurrent and/or a short current is applied to the MCU 810, when errors occur in the MCU 810, the MCU 810 may not detect the overcurrent and/or the short current. According to the embodiment, even if errors occur in the MCU 810, the MCU 810 detects the overcurrent and/or the short current using the load switch 821 and the protection circuit controller 822, thereby preventing the abnormal operation of the heating unit 830.

Also, when the operation period of the heating unit 830, measured by the timer 823, exceeds the first threshold value, the protection circuit controller 822 may control the load switch 821 to stop the supply of power to the heating unit 830.

Also, when the comparator 823 determines that the duty ratio of power supplied to the heating unit 830 is maintained at the same value for a certain time, the protection circuit controller 822 may control the load switch 821 to stop the supply of power to the heating unit 830.

Figure 9:
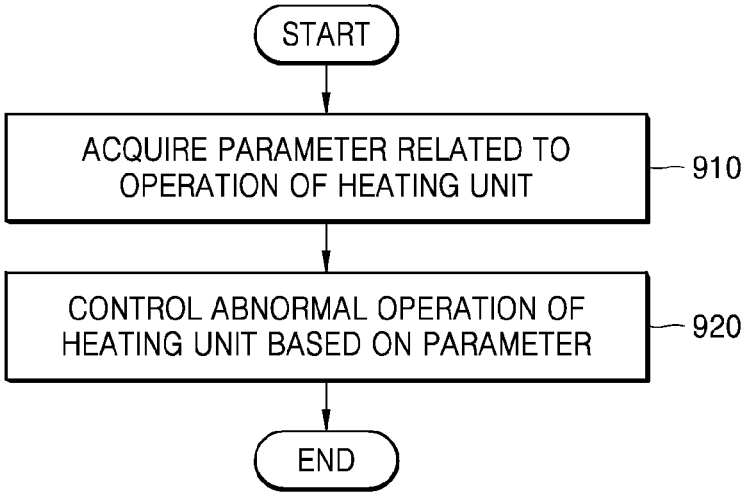
FIG. 9 is a flowchart illustrating a method of controlling an aerosol generating device according to an embodiment.

FIG. 9 is a flowchart illustrating a method of controlling an aerosol generating device according to an embodiment.

Referring to FIG. 9, in operation 910, a protection circuit controller may acquire at least one parameter related to the operation of a heating unit.

The protection circuit controller may be implemented by hardware independent of an MCU.

In an embodiment, the protection circuit controller may acquire an operation period of the heating unit as a parameter. Specifically, the protection circuit controller may include a timer. When the operation of the heating unit starts, the timer starts measurement, and when the operation of the heating unit is stopped, the timer may stop the measurement. The operation starts or is stopped based on whether or not power is supplied to the heating unit, so that the timer may accurately measure the operation period of the heating unit.

Also, the protection circuit controller may acquire the duty ratio of power supplied to the heating unit as a parameter. The MCU may control the amount of power supplied to the heating unit using the PID control method. The protection circuit controller may receive a duty ratio control signal from the MCU.

Also, the protection circuit controller may acquire power supplied to the heating unit as a parameter.

In operation 920, the protection circuit controller may detect and control an abnormal operation of the heating unit based on the at least one parameter.

In an embodiment, the protection circuit controller may measure the operation period of the heating unit, compare the operation period with a first threshold value, and stop the supply of power to the heating unit. That is, when the operation period of the heating unit received from the timer exceeds the first threshold value, the protection circuit controller may determine that the heating unit is operating abnormally and may stop supplying power to the heating unit.

Also, the protection circuit controller may receive the duty ratio of power supplied to the heating unit from the MCU, and when the duty ratio is maintained at the same value for a certain time, the supply of power to the heating unit may be stopped. When the MCU controls the amount of power to be supplied to the heating unit using the PID control method, the duty ratio is changed continuously. That is, the duty ratio of power supplied to the heating unit maintained at the same value for a certain time may be a case where errors occur in a duty ratio control algorithm of the MCU.

Also, when power supplied to the heating unit is out of the preset range, the protection circuit controller may stop supplying power to the heating unit.

Specifically, when the power delivered to the heating unit exceeds a threshold upper limit, the protection circuit controller may stop supplying power to the heating unit. Alternatively, when the power delivered to the heating unit is less than or equal to the threshold lower limit, the protection circuit controller may stop supplying power to the heating unit.

One or more embodiments of the disclosure may be implemented in the form of a recording medium including instructions executable by a computer, such as a program module executable by the computer. A computer-readable recording medium may be any available medium that can be accessed by a computer and includes both volatile and nonvolatile media, and removable and non-removable media. In addition, the computer-readable recording medium may include both a computer storage medium and a communication medium. The computer storage medium includes all of volatile and nonvolatile, and removable and non-removable media implemented by any method or technology for storage of information such as computer-readable instructions, data structures, program modules or other data. The communication medium typically includes computer-readable instructions, data structures, other data in modulated data signals such as program modules, or other transmission mechanisms, and includes any information transfer media.

At least one of the components, elements, modules or units (collectively "components" in this paragraph) represented by a block in the drawings, such as the MCU in FIGS. 6 through 8, may be embodied as various numbers of hardware, software and/or firmware structures that execute respective functions described above, according to an exemplary embodiment. For example, at least one of these components may use a direct circuit structure, such as a memory, a processor, a logic circuit, a look-up table, etc. that may execute the respective functions through controls of one or more microprocessors or other control apparatuses. Also, at least one of these components may be specifically embodied by a module, a program, or a part of code, which contains one or more executable instructions for performing specified logic functions, and executed by one or more microprocessors or other control apparatuses. Further, at least one of these components may include or may be implemented by a processor such as a central processing unit (CPU) that performs the respective functions, a microprocessor, or the like. Two or more of these components may be combined into one single component which performs all operations or functions of the combined two or more components. Also, at least part of functions of at least one of these components may be performed by another of these components. Further, although a bus is not illustrated in the above block diagrams, communication between the components may be performed through the bus. Functional aspects of the above exemplary embodiments may be implemented in algorithms that execute on one or more processors. Furthermore, the components represented by a block or processing steps may employ any number of related art techniques for electronics configuration, signal processing and/or control, data processing and the like.

The above-described embodiments are merely examples, and it will be understood by one of ordinary skill in the art that various changes and equivalents thereof may be made without departing from the scope of the disclosure. Therefore, the scope of the disclosure should be defined by the appended claims, and any modifications, substitutions, improvements and equivalents thereof should be construed as falling within the scope of the disclosure and protection defined by the claims.

The invention claimed is:

1. An aerosol generating device comprising:

a heating unit configured to heat an aerosol generating material;

a battery configured to supply power to the heating unit;

a micro controller unit (MCU) configured to control an operation of the heating unit; and a protection circuit controller, wherein the protection circuit controller stops the supply of power to the heating unit when a duty ratio of power supplied to the heating unit is maintained at a same value for a certain time.

2. The aerosol generating device of claim 1, wherein the protection circuit controller measures an operation period of the heating unit, and compares the operation period with a first threshold value and stops the supply of power to the heating unit.

3. The aerosol generating device of claim 2, wherein the protection circuit controller further comprises a timer, and when an operation of the heating unit starts, the timer starts measurement, and when the operation of the heating unit is stopped, the timer stops measurement.

4. The aerosol generating device of claim 2, further comprising a load switch configured to receive power from the battery and to deliver the supplied power to the heating unit, wherein the protection circuit controller controls the load switch to stop the supply of power to the heating unit when the operation period exceeds a first threshold value.

5. The aerosol generating device of claim 1, wherein the protection circuit controller receives the duty ratio of power supplied to the heating unit from the MCU.

6. The aerosol generating device of claim 5, wherein the protection circuit controller further comprises a comparator, and the comparator determines whether or not the duty ratio is maintained at the same value for a certain time.

7. The aerosol generating device of claim 5, further comprising a load switch configured to receive power from the battery and to deliver the supplied power to the heating unit, wherein the protection circuit controller controls the load switch to stop the supply of power to the heating unit when the duty ratio is maintained at the same value for a certain time.

8. The aerosol generating device of claim 5, wherein the MCU controls power supplied to the heating unit in a proportional-integral-differential (PID) manner.

9. The aerosol generating device of claim 1, further comprising a load switch configured to receive power from the battery and to deliver the supplied power to the heating unit.

10. The aerosol generating device of claim 9, wherein, when power delivered to the heating unit is out of a preset range, the load switch delivers an error signal to the protection circuit controller, and the protection circuit controller controls the load switch to stop the supply of power to the heating unit.

* * * * *